US005934886A

United States Patent [19]

Bushnell

[11] Patent Number: 5,934,886

[45] Date of Patent: Aug. 10, 1999

[54] METERING PUMP WITH PISTON AND DIAPHRAGMS

[75] Inventor: Raymond B. Bushnell, Oregon City, Oreg.

[73] Assignee: Arizona Green Pump, Inc., Tucson, Ariz.

[21] Appl. No.: 08/910,448

[22] Filed: Aug. 5, 1997

Related U.S. Application Data

[63] Continuation-in-part of application No. 08/764,943, Dec. 13, 1996, abandoned.

[51] Int. Cl.[6] ..... F04B 43/06

[52] U.S. Cl. ..... 417/395; 417/389

[58] Field of Search ..... 417/389, 390, 417/395

[56] References Cited

U.S. PATENT DOCUMENTS 3,604,213 9/1971 Parsons ..... 417/389

4,523,901 6/1985 Schippers et al. ..... 417/390

5,279,504 1/1994 Williams ..... 417/395

FOREIGN PATENT DOCUMENTS 4025-114 2/1992 Germany ..... 417/395

*Primary Examiner*—Timothy S. Thorpe
*Assistant Examiner*—Cheryl J. Tyler
*Attorney, Agent, or Firm*—James D. Givnan, Jr.

[57] ABSTRACT

A diaphragm pump is powered by fluctuating pressure in a pressurized conduit. A three way valve is cycled to alternately pressurize and vent the pump. A power diaphragm drives a piston having a skirt with a reduced end wall to displace a quantity of hydraulic fluid from a pump chamber to drive a pumping diaphragm. An inlet of the pump admits a quantity of fluid to be discharged via a pump outlet. A spring component biases the piston to return same upon venting of the pressurized conduit. The diaphragm pump is shown in a pumping system wherein a primary pump and an intermittently cycled three way valve operate the diaphragm pump to inject fluid into the output conduit from the primary pump.

4 Claims, 1 Drawing Sheet

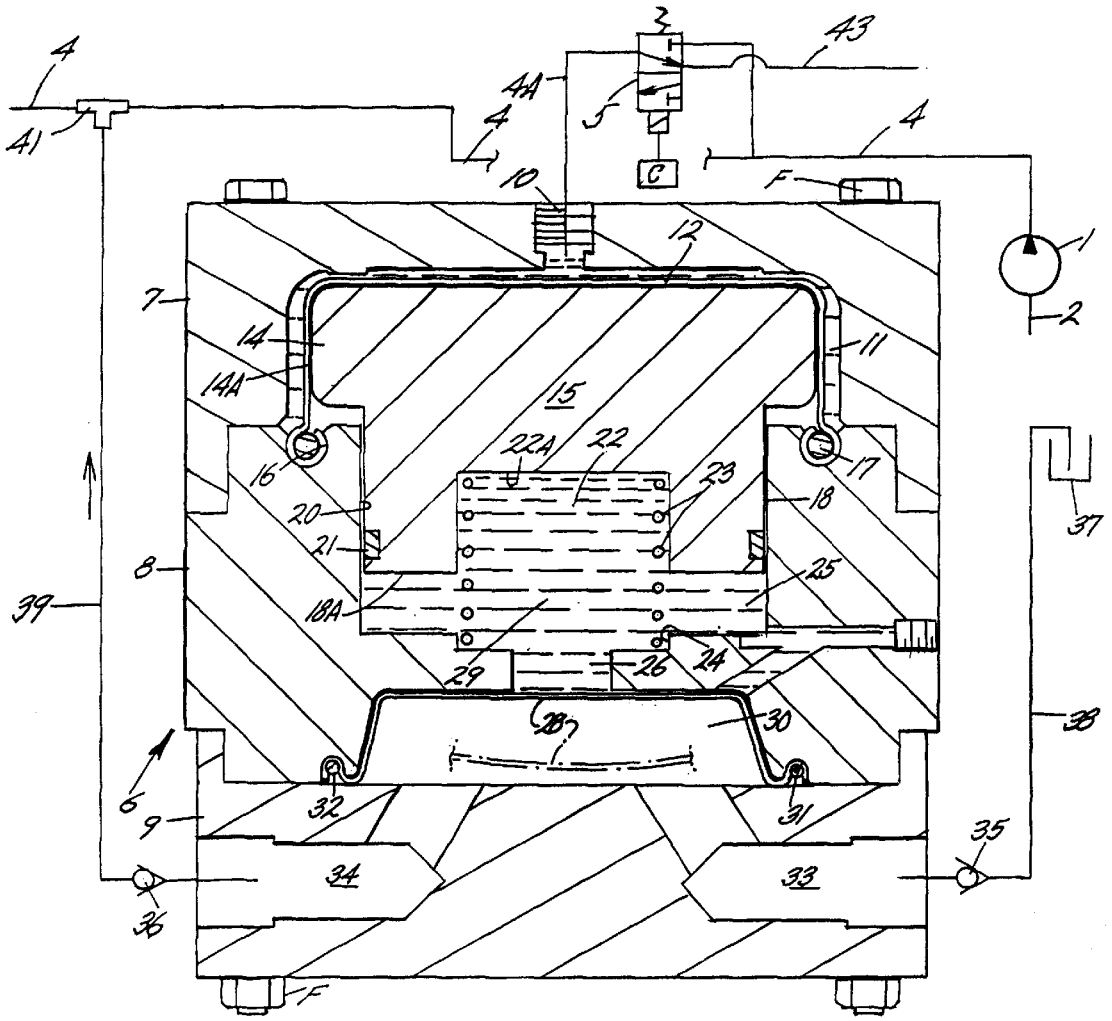
4
41
4
4A
5
43
4
C
10
F
12
1
2
7
14
14A
11
15
22A
22
16
17
23
20
18
21
37
8
25
39
18A
29
26
24
28
30
38
6
32
31
9
35
34
33
36
F

METERING PUMP WITH PISTON AND DIAPHRAGMS

BACKGROUND OF THE INVENTION

This is a continuation-in-part of application Ser. No. 08/764,943 filed Dec. 13, 1996 by the present inventor and now abandoned.

The present invention relates generally to metering pumps for injecting an intermittent output into a flow line.

Known in the pump prior art are multiple diaphragm pumps, as for example, the pump disclosed in U.S. Pat. No. 5,279,504 wherein pneumatic pressure exerted on a first diaphragm displaces same and a stem coupled to the diaphragm and a fixed volume of fluid to act on a second diaphragm in communication with a source of fluid and with a discharge conduit. The stem is coupled to each diaphragm by means of disks 42 and 64 in one form of the pump. Diaphragm flexing appears to be significant at the disk-diaphragm interfaces. Such diaphragm mounted disks may also be subject to corrosion depending on the fluid pumped.

U.S. Pat. No. 3,387,563 shows a multiple diaphragm valve 1 which intermittently actuates a drive unit 3 for powering an injection plunger 53 of an injection pump 4. Diaphragms 15, 16 and 29 are associated with a valve armature 17.

Certain chemicals now used in liquid fertilizers require the addition of a neutralizer immediately prior to fertilizer application. Known metering pumps have not been able to achieve the desired injection of such neutralizers into a fertilizer flow line by reason of their corrosive nature.

SUMMARY OF THE PRESENT INVENTION

The present invention is embodied in a diaphragm pump including a diaphragm and piston, responsive to pressure fluctuations in a power source acting on a confined quantity of fluid to actuate a second pumping diaphragm.

The present diaphragm pump utilizes pressure fluctuation in a fluid line. The diaphragms of the present pump are free flexing in that they are not perforate or apertured for securement to a corrosive susceptible mechanical link between the diaphragms. A first or power diaphragm extends across a piston having an enlarged head portion with the piston biased by a compression spring into engagement with the first diaphragm. A reduced lower end wall of the piston has a recessed area in which one end of the compression spring is confined. A quantity of trapped liquid occupies a chamber pressurized by reduced piston end wall and moves into and out of a pumping chamber whereat a second or pumping diaphragm is located.

Important objectives of the present pump include the provision of a pump particularly suited for pressurizing highly corrosive materials by utilizing a diaphragm and piston combination to pressurize a quantity of trapped fluid for actuating an pumping diaphragm unencumbered by mechanical components; the provision of a pump responsive to periodic pressurization of a power source line and utilizing same to drive a diaphragm and piston acting on a trapped fluid to impart a pumping action to a second or pumping diaphragm to periodically discharge fluid at a pressure sufficient to inject same back into a main flow from a pump also pressurizing the power source line; the provision of a primary pump output pump powered by pressure fluctuations in a line and having moving components of non-corrosive material and with a pumping diaphragm attached only about its perimeter to other components of the pump to ensure extended trouble free operation.

BRIEF DESCRIPTION OF THE DRAWING

In the accompanying drawing, the FIGURE is a vertical sectional view of a pump embodying the present invention.

DETAILED DESCRIPTION OF THE PREFERRED EMBODIMENTS

With continuing attention to the drawing, wherein the following described components are identified by reference numerals also utilized in the following description.

Indicated at 1 is a positive displacement primary pump having a supply line 2 in unseen communication with a source of fluid to be pumped. A pump output conduit 4 also serves the following described metering pump. A three way valve 5 is solenoid actuated with a settable control C determining cycling of the valve.

A body 6 of the present metering pump is comprised of body members 7, 8 and 9 joined as by fastener assemblies F passing therethrough. A port 10 of the valve body is in communication with valve 5 to admit fluid pressure subject to opening and closing of valve 5. Member 7 of the valve body defines a chamber 11 which receives a diaphragm 12 and the head 14 of a piston 15. Diaphragm 12 spans head 14 of piston 15 and extends along the head side wall at 14A. An annular groove 16 receives a diaphragm retainer ring 17 to secure the diaphragm perimeter. A piston skirt 18 is received in a cylindrical bore 20 in body member 8 with a seal 21 to prevent fluid passage from a following noted source below the piston. A recessed area 22 of the skirt houses a compression spring 23 which bears on piston 15 while a supported end of the spring is confined within a shouldered area 24 of body component 8. Body member 8, along with a reduced end wall 18A of piston skirt 18, define a fluid filled chamber 25 which includes piston recessed area 22 housing spring 23. A port 26 defines a portion of fluid chamber 25. A quantity of hydraulic fluid is at 29.

A pumping or second diaphragm 28 is located in a cavity 30 in body 8 with the diaphragm central area fully responsive to fluid pressure and unrestrained by attached pistons, stems, etc., while the perimeter of the diaphragm is confined within an annular groove 31 by a suitable retainer ring 32. Chamber 28 is in communication with a check valve 35 and a check valve 36 with the former permitting an intake flow via a conduit 38 from a source 37. Chamber 30 is charged with a fluid flow from a source 37 through inlet 33 with the fluid flow displacing diaphragm 28 to the position shown in full lines. Displacement of diaphragm 28 occurs simultaneously with movement of piston 15 to effect the intake and discharge of fluid from chamber 30 respectively via inlet 33 and outlet 34 and ultimately via a line 39 to tee 41 in flow line 4. Check valves 35 and 36 permit an amount of fluid to enter cavity 30 upon spring biased retraction of piston 15 towards the full line position shown coincident with valve 5 being in the venting condition shown. As the output pressure of pump 1 in line 4A is subject to cycling of valve 5 causing pressure fluctuations the power stroke of piston 15 is initiated upon shifting of the valve core. During peak pressure in line 4A power diaphragm 12 and piston 15 are displaced to drive diaphragm 28 for the discharge of hyrdraulic fluid from chamber 30. The resultant pressure increase or differential in an injection line 39 ensures fluid injection into conduit 4 at a tee 41. A vent line 43 vents pump pressure from the metering pump during return of piston 15.

In one embodiment of the present pump valve body member 9 is preferably coated with a material resistant to corrosion. Pumping diaphragm 28 may also be coated for resistance to the adverse effects of various fluids to be injected. Piston 15 may be formed from a synthetic material for reducing friction with diaphragm 12. Hydraulic fluid in chamber 25 lubricates seal 21. A settable control C varies cycling duration of valve 5.

While a single pump 1 is disclosed as providing both a power source for driving the diaphragm pump and providing an output flow through line 4, in some instances diaphragm pump operation and a fluid flow through line 4 may be the function of separate pumps or other fluid pressure sources.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. A diaphragm pump powered by pulsating fluid pressure in a primary pump output conduit also serving the diaphragm pump, said diaphragm pump comprising:

a pump body for communication with the fluid conduit, a piston housed in said pump body having a head and a skirt end wall of lesser diameter than said head, a power diaphragm displaceable in one direction by a first fluid pressure in the fluid conduit to drive said piston in a power stroke, a chamber defined by said piston skirt end wall and said pump body, a pumping diaphragm in communication with said chamber, said pumping diaphragm having a perimeter and being contrained from axial movement only about said perimeter, a quantity of fluid fully occupying said chamber and pressurized by said piston, said fluid displacing said pumping diaphragm, and inlet and outlet means directing fluid to be pumped to one side of said pumping diaphragm and from said one side of the pumping diaphragm to a discharge line, and piston travel being in response to said power diaphragm when displaced in said one direction serving to pressurize the quantity of fluid in said chamber to drive the pumping diaphragm to pressurize the fluid to be pumped at a second fluid pressure exceeding said first fluid pressure.

2. The diaphragm pump claimed in claim 1 additionally including a resilient member biasing said piston in a direction opposite to said power stroke, said skirt end wall defining a recessed area in which said resilient member is partially housed.

3. The diaphragm pump claimed in claim 1 wherein said power diaphragm is in surfacial contact with said piston head and a side wall of the piston.

4. In a pumping system having a single pressure source, the improvement comprising:

a primary pump serving a fluid conduit, directional valve means in communication with said fluid conduit, control means actuating said valve means to cycle same, a metering pump body in communication with said valve means, a piston housed in said pump body having a head and an end wall of lesser diameter and surface area than said head, a power diaphragm overlying said head and displaceable in one direction by a first fluid pressure in the fluid conduit to drive said piston in a power stroke, a chamber partially defined by said end wall of the piston and said pump body, a pumping diaphragm in communication with said chamber, said pumping diaphragm having a perimeter and being contrained from axial movement only about said perimeter, a quantity of fluid in said chamber pressurized by said end wall of the piston and displacing said pumping diaphragm, inlet and outlet means directing fluid to be pumped to one side of said pumping diaphragm and from said one side of the pumping diaphragm, piston travel in response to said power diaphragm when displaced in said one direction serving to pressurize the quantity of fluid in said chamber to drive the pumping diaphragm and pressurize fluid therein to a second fluid pressure exceeding said first fluid pressure, an injection line served by said outlet means and terminating in communication with said fluid conduit for discharging metering pump body output into the fluid conduit served by the primary pump.

* * * * *